US005119998A

United States Patent [19]

Tholander et al.

[11] Patent Number: 5,119,998

[45] Date of Patent: Jun. 9, 1992

[54] METHOD FOR CONTROLLING A YARN STORAGE AND FEEDING DEVICE, AND YARN STORAGE AND FEEDING DEVICE

[75] Inventors: Lars H. G. Tholander, Ulricehamn; Martin J. Hellström, Nol; Pär A. T. Josefsson, Boras, all of Sweden

[73] Assignee: IRO AB, Ulricehamn, Sweden

[21] Appl. No.: 613,475

[22] PCT Filed: Mar. 8, 1989

[86] PCT No.: PCT/EP89/00241

§ 371 Date: Oct. 26, 1990

§ 102(e) Date: Oct. 26, 1990

[87] PCT Pub. No.: WO89/08600

PCT Pub. Date: Sep. 21, 1989

[30] Foreign Application Priority Data

Mar. 8, 1988 [SE] Sweden ..... 8800839

[51] Int. Cl.[5] ..... B65H 51/20; D03D 47/34

[52] U.S. Cl. ..... 242/47.01; 139/452

[58] Field of Search ..... 242/47.01, 47.04, 47.05, 242/47.06, 47.07, 47.08, 47.09, 47.1, 47.11, 47.12, 47.13, 47; 139/452

[56] References Cited

U.S. PATENT DOCUMENTS 4,226,379 10/1980 Brouwer et al. ..... 242/47.01
4,298,172 11/1981 Hellstrom ..... 242/47.01
4,452,402 6/1984 Ghiardo ..... 242/47.01
4,617,971 10/1986 Hellstrom ..... 242/47.01 X
4,676,442 6/1987 Tholander et al. ..... 242/47.01
4,687,149 8/1987 Riva ..... 242/47.01
4,715,411 12/1987 Van Bogaert et al. ..... 242/47.01 X

FOREIGN PATENT DOCUMENTS 2221655 8/1977 Fed. Rep. of Germany .

*Primary Examiner*—Stanley N. Gilreath
*Attorney, Agent, or Firm*—Flynn, Thiel, Boutell & Tanis

[57] ABSTRACT

In a method for controlling a yarn storage and feeding device, particularly for a mechanical loom, comprising a storage surface adapted to have windings of a yarn wound thereonto and withdrawn therefrom by a consumer, and a control unit for a winding drive mechanism operable to adjust the winding speed in accordance with the consumption rate and in response at least to the actual value of the number of yarn windings on the storage surface, for adjusting the actual value towards a predetermined desired value, the desired value is altered in response to at least one alteration of the winding speed to thereby obtain an optimum smallness of the yarn supply on the storage surface. In a yarn storage and feeding device for performing this method, the control unit cooperates with a reference value memory (18) for the supply of desired values (nV) varying in a predetermined manner.

22 Claims, 3 Drawing Sheets

METHOD FOR CONTROLLING A YARN STORAGE AND FEEDING DEVICE, AND YARN STORAGE AND FEEDING DEVICE

FIELD OF THE INVENTION

The present invention relates to a method for controlling a yarn storage and feeding device, and to a yarn storage and feeding device suitable for performing the above method.

BACKGROUND OF THE INVENTION

According to EP B1 01 74 039, the winding speed at which yarn is wound onto the yarn storage surface is adjusted in accordance with the difference between a predetermined desired value and an actual value of the number of yarn windings supported on the storage surface, and in such a manner, that this difference varies within a limited range between a positive value and a negative value. The desired value corresponds to the number of yarn windings required for satisfying a mean consumption. Although in this case a low winding speed in combination with a low mean consumption results in the creation of a suitably adapted yarn supply, a yarn supply of the same magnitude is not required at higher winding speeds. In the case of a state of equilibrium between the winding speed and the mean consumption, an increase of the yarn consumption at higher winding speeds results in that the yarn supply is replenished at a faster rate than in the case of lower winding speeds, due to the high-speed operation of the winding drive mechanism. An excessive yarn supply is undesirable, however, particularly in the higher winding speed range, because the danger of windings being wound upon one another is increased, and because the winding speed during the replenishment of the yarn supply to an unnecessary size tends to become excessive. Also during the replenishment of the yarn supply to an unnecessary size, the adaptation of the winding speed to a new state of equilibrium after a change of the consumption takes a long time, and excessive speed results in an undesirable increase of the mechanical stress acting on the yarn, involving the danger of yarn breakage, particularly at the yarn supply side. Also the size of the yarn supply can be further and excessively increased, proceeding from the already unnecessarily great yarn supply, in the case of a delay caused by a decrease of the yarn consumption. The great number of windings in the excessively great yarn supply hampers the advance of the yarn supply. The temporarily excessive speed and the mostly excessive yarn supply also result in an unnecessary energy consumption.

It is an object of the invention to provide a method and a yarn storage and feeder device to thereby ensure the presence of a yarn supply of optimum magnitude on the storage surface.

These objects are attained according to the invention by a method and device having the characteristics set forth below.

Both in the case of the method and of the device, the proposed object is simply attained by the consideration that, in the case of higher winding speeds, the winding drive mechanism is capable in response to an increase of consumption of replenishing the yarn supply to the necessary size more rapidly than in the case of lower winding speeds, and that without the danger of the yarn supply being completely depleted, so that the yarn supply can be smaller at higher winding speeds than at lower winding speeds. This is brought about by respective changes of the desired value. In the case of a decrease of consumption, the change of the desired value prevents the size of the yarn supply from being undesirably increased, the selected desired value being effective to adjust the yarn supply to the minimum size required for the reduced consumption. The manner in or the law by which the desired value is varied is at least in part dependent on the capacity of the winding drive mechanism, which may be represented by a known characteristic curve specific to the respective device. This characteristic curve may for instance be the acceleration curve of the winding drive mechanism. The consumption, or the characteristic of the consumption, respectively, is likewise of importance with regard to the variation of the desired value. It is to be preceeded from the assumption, however, that the yarn storage and feeding device is a priori matched to the consumer in such a manner that a reliable yarn supply is ensured under any operative conditions to be expected. The variation of the desired value is of particular importance not only during normal operation, but also in the starting phase and in the run-out phase down to the stopped condition, because under these circumstances the desired value plays an important role by preventing the occurrence of excessive speeds, and the formation of an excessive yarn supply in the run-out phase, respectively. The reduction of the yarn supply to its optimum size for any consumption rate results in various advantages. In the first place, the adjusted size of the yarn supply reduces the danger of windings being wound upon one another. The drag forces opposing the advance of the yarn supply are considerably reduced. Furthermore there results a reduced maximum speed of the winding drive mechanism, because in the case of an increased consumption rate the winding speed will no longer become excessive to thereby create the unnecessarily great yarn supply for this high winding speed. By the avoidance of such excessive speeds the mechanical stress acting on the yarn, particularly on the supply side, is reduced, with the resultant reduction of the danger of yarn breakage at this location. The formerly unavoidable swinging adjustment of the winding speed towards equilibrium with the consumption rate is eliminated, because the winding speed is adjusted in harmony to the consumption rate with the aid of the desired values. The elimination of the swinging adjustment results in the applicable state of equilibrium being attained very quickly. After the winding speed has been reduced in response to the consumption rate, the size of the yarn supply is immediately matched to the new consumption rate, because the winding speed is matched to the consumption rate without any noticeable swinging adjustment as a result of the variation of the desired value.

In summary, the method according to the invention and the construction of the yarn storage and feeding device result in an improved quality of the yarn feeding process with improved energy husbandry and reduced danger of malfunction.

One embodiment of the method permits the optimum small size of the yarn supply to be obtained in each case in a simple manner. The higher the winding speed at a given state of equilibrium, the smaller is the yarn supply. Since the variation of the desired value is brought about in an automatic manner, there is no need for external intervention.

Another provision takes into account that a relatively great yarn supply is required at lower winding speeds, because in the case of an increase of the consumption rate the winding drive mechanism is only capable of replenishing the supply at a slow rate.

A starting number can be established in view of the fact that the winding drive mechanism, proceeding from the stopped condition, requires a relatively long time for building the yarn supply up to the necessary size in the case of an increase of the consumption rate. The starting number may thus correspond to the desired value for the slowest winding speed (standstill). It is also conceivable, however, to select a higher starting number, and to commence the adjustment of the winding speed in accordance with the variation of the desired value only after a predetermined winding speed or a state of equilibrium has been attained. The starting number is also required for the initial establishment of the yarn supply. Under the assumption of a known and substantially constant mean consumption rate, the desired objective can also be attained with at least one alteration of the desired value, i.e. by applying to the control unit at least one desired value different from the starting number and matched to the known mean consumption rate, to thereby ensure that the yarn supply at this mean consumption rate is of optimum smallness, i.e. smaller than during the start-up phase. The respective desired value, or rather the alteration of the desired value, preferably comes into effect with regard to the control function when the state of equilibrium has been attained after the start-up phase of the drive mechanism. In this manner it is possible to suppress a swinging adjustment phase, because this adjustment of the winding speed is carried out soon after leaving the starting number by matching the winding speed to the desired value.

When the control of the winding speed according to the desired values is effective to always ensure the optimum smallness of the yarn supply, and the winding speed control process proceeds in a harmonic manner, the result is a limitation not only of the mechanical stresses acting on the yarn, but also the variations of the yarn tension on the supply side.

The characteristic acceleration curve of the winding drive mechanism is a very useful point of departure for determining the different desired values. This is because the speed at which the yarn supply is replenished or diminished is to a large extent dependent on the acceleration and/or deceleration response of the winding drive mechanism. This proceeds from the assumption that the actual diameter of the storage surface, which may also be adjustable, or the yarn quality are only of secondary importance.

The desired value may be determined in accordance with the known mean consumption rate, i.e. the desired value is either calculated or empirically determined and applied to the control unit for use in its operation.

One manner of conducting the method permits a very fine control function to be achieved. The frequency at which the information comparison is repeated depends on the actually given operating conditions. This frequency may also be selected to be higher or lower, for instance by means of an adjustable clock generator for the control unit.

Of particular advantage in this context is the performance of the method using a closed control loop, because the closed control loop, which is dominated by the desired values acting as reference values, permits a very fine control function to be achieved.

In the yarn storage and feeding device according to the invention, the speed control function of the control unit is influenced by a reference value memory so as to establish and maintain the optimum smallness of the yarn supply at any winding speed value. Since the operation of the control unit is governed by the desired values, an increase of the winding speed to excessive values in response to an increase of the consumption rate is avoided in the same manner as an undesirable increase of the size of the yarn supply in response to a reduced consumption rate. The mechanical stresses acting on the yarn are thus maintained as small as possible. The optimum smallness of the yarn supply in each winding speed range notwithstanding, the complete exhaustion of the yarn supply in response to an increase of the consumption rate is reliably avoided.

The acceleration curve of the winding drive mechanism is a known reference line and as such is useful for calculating or determining the desired values.

A further advantageous embodiment includes a microprocessor in the control unit and detector means acting to supply the control unit with informations relating to the number of windings as wound and the number of windings as consumed, and further relating to at least one desired value. The microprocessor is suitably informed of the actual value in an analogous process, for instance by counting the yarn windings. Under certain conditions it could be sufficient to detect the actual value by directly scanning the storage surface by means of a plurality of yarn detectors, preferably at least three yarn detectors, to thereby create near-analogous information for the control unit. The microprocessor in the control unit is charged with an additional function, which however, it is capable of performing without any problem. The winding speed is adjusted in accordance with the desired values in such a manner that at higher winding speed values the size of the yarn supply is reduced at the same rate as the increased speed permits the winding drive mechanism to replenish the yarn supply more rapidly. Also in the case of a reduced consumption rate, the microprocessor acts to ensure that the yarn supply is not undesirably increased.

In one embodiment, a tabular memory stores the desired values in the form of a sequence, which may be of a density practically resulting in a continuous desired-value curve. A reading pointer is adjustable in accordance with the winding speed to read only a respective one of the desired values at any time and to transmit the information derived therefrom to the control unit. For applications of a more simple nature it is also sufficient, however, to provide the desired values at greater intervals, so that only selected winding speed values are concerned, with significant desired-value changes occurring therebetween. In the case of a known mean consumption rate, a single stage may be sufficient, i.e. the then applicable desired value is matched with this consumption rate.

A further alternative embodiment switches from one yarn detector to the next automatically, which results in the associated new desired value becoming effective. The result, however, is a desired-value curve with a number of steps in the course of the curve corresponding to the number of yarn detectors. This is quite sufficient, however, for attaining the desired objective, particularly when there is a great number of such detectors. The spacings between the individual yarn detectors may be individually adjustable. It is thus not necessary to select accurately equal spacings.

If the yarn detector is adjusted in the longitudinal direction of the storage surface in accordance with the winding speed, this adjustment results in a variation of the desired value determining the function of the control unit for the adjustment of the winding speed.

In another embodiment, the desired value is electronically varied by adjusting the limited active detecting section of a wide-band detector. In a simplified form it would even be sufficient to provide a wide-band detector with a longitudinally displaceable shutter opening permitting the location whereat the wide-band detector scans the storage surface to be displaced in response to variations of the winding speed, to thereby vary the desired value.

Association of the desired values to winding speed values selected at uniform intervals is favourable for obtaining a stable control response.

Since the capability of the winding drive mechanism of replenishing the yarn supply more rapidly at higher winding speeds than at lower winding speeds may vary in accordance with the speed in a non-linear proportion, in the range of the lower winding speed values the differences between the desired values may be relatively small. The differences between the desired values are then of course relatively greater at higher winding speed values.

One embodiment includes a particularly simple construction permitting the desired value corresponding to the known mean consumption rate to be applied to the electronic control unit in a particularly simple manner. The desired value can be individually adjusted and is automatically accepted and used by the control unit for maintaining the yarn supply desirably small during normal operation.

BRIEF DESCRIPTION OF THE DRAWINGS

Embodiments of the subject matter of the invention shall now be described by way of example with reference to the accompanying drawings, wherein.

DETAILED DESCRIPTION

Figure 1:
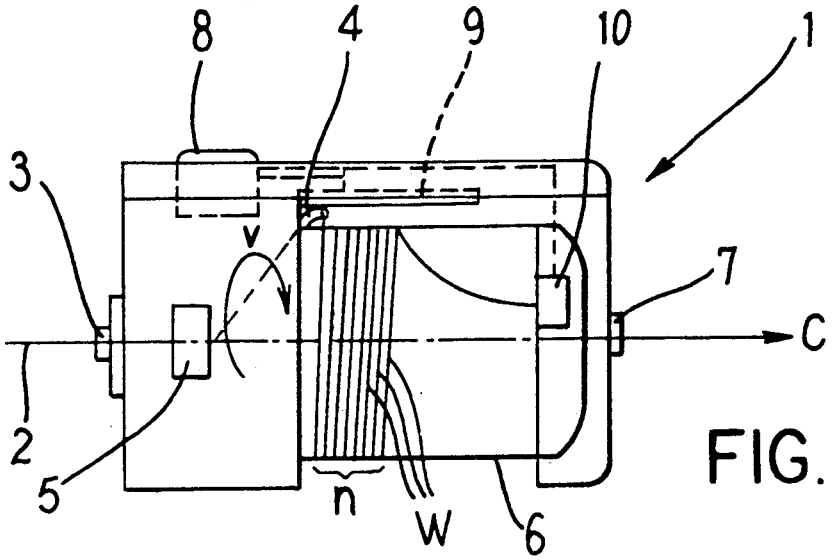
FIG. 1 shows a diagrammatical side view of a yarn storage and feeding device.

In a yarn storage and feeding device 1 as shown in FIG. 1, a yarn 2 supplied from a (not shown) supply bobbin passes through an inlet end 3 to be wound by means of a winding element 4 onto a stationary storage surface 6 in the form of windings W. The number of windings W forming the yarn supply is designated "n". Through an exit end 7 yarn 2 is withdrawn over the free end of storage surface 6 by a consumer C, for instance a mechanical loom. Winding element 4 is rotated at a winding speed V by a winding drive mechanism 5. Drive mechanism 5 is operatively connected to a control unit 8 adapted to have signals of a diagrammatically indicated detecting device 9 and a detector element 10 applied thereto.

Detecting device 9 (for instance a Hall element) may be operable to monitor winding element 4, so that the passage thereby of winding element 4 or yarn 2 results in at least one pulse being applied to control unit 8, each such pulse representing for instance one winding W of yarn 2. In a similar manner detector element 10 may be operable to generate a pulse for each passage thereby of yarn 2 as it is being withdrawn. By comparison of these signals control unit 8 is capable of determining the actual number n of the windings W on storage surface 6. It is conceivable that detecting device 9 comprises other (not shown) detecting elements for determining the number of yarn windings W or the axial dimension of the yarn supply, respectively, in a near-analogous manner and for supplying the respective informations to control unit 8.

Control unit 8 operates to match the winding speed V to the yarn consumption, so that, after a state of equilibrium between the mean consumption rate and the winding speed has been achieved, the length of yarn 2 wound onto storage surface 6 per time unit (for instance m/min) accurately corresponds to the length of yarn unwound therefrom.

When yarn 2 is for instance a weft yarn for a mechanical loom, the operating mode of the loom determines a mean consumption rate, since the weft yarn is withdrawn at regular, shorter or longer intervals (regular colour change or plain weaving mode), or at irregular, shorter or longer intervals (free pattern weaving mode). Although during each weft cycle the acceleration and deceleration of the weft yarn is greater than the possible acceleration and deceleration of drive mechanism 5 as illustrated by the respective acceleration characteristic, control unit 8 responds to the mean consumption rate in such a manner that drive mechanism 5 operates continuously at a relatively high speed in the case of a high weft cycle frequency, and likewise continuously, although at a correspondingly reduced speed, in the case of an irregular or lower weft cycle frequency. When the mean consumption rate is varied during normal operation, control unit 8 operates to correspondingly adjust the winding speed until a state of equilibrium is again achieved. Maintaining this state of equilibrium does not necessarily require the winding speed to be altered for each weft cycle, because the adjusted winding speed is sufficient for suitably replenishing the yarn supply during the intervals between weft cycles.

Since the state of equilibrium at a higher consumption rate and at a higher winding speed requires the yarn supply to be replenished more rapidly than in the case of a lower mean consumption and a lower winding speed, the control operation is carried out in such a manner that the size of the yarn supply is reduced in response to increasing winding speeds, and that at the same time it is ensured that the size of the yarn supply never drops below an operatively indispensable value as it is being consumed.

Figure 2:
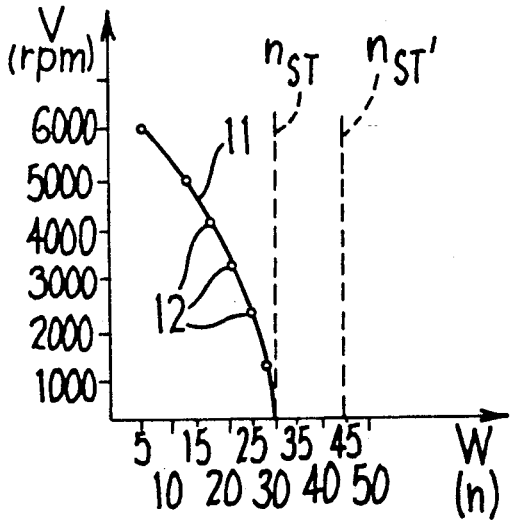
FIG. 2 shows a diagram illustrating the development of desired values.

In the yarn storage and feeding device 1 of FIG. 1, the desired value nV for the number of yarn windings W on storage surface 6 is varied in accordance with variations of the winding speed V, as shown in FIG. 2, so that the desired value nV is reduced in response to an increase of the winding speed V, and increased in response to a decrease of the winding speed. The diagram of the winding speed V over the number of windings W thus shows a desired-value curve 11 defined by points 12 and extending along an arc to the left from a desired value nST. Desired value nST defines a starting number established in accordance with the acceleration characteristic of drive mechanism 5 and/or the maximum consumption rate in such a manner that the yarn supply is just prevented from being completely exhausted during start-up from a winding speed Zero. As indicated in FIG. 2 at nST', the starting number may also be greater, in which case control unit 8 considers the desired values of curve 11 only beyond a determined winding speed value and controls the operation of drive mechanism 5 only beyond the respective winding speed value, and then in accordance with curve 11, to thereby adjust the yarn supply to a predetermined smallness in accordance with the desired values defined by points 12. For enabling control unit 8 in the last-named case to adjust the number of windings to the starting number nST', the device may be provided with a starting detector ST as shown for instance in FIG. 5, this starting detector being adapted to participate in the control operation only during the starting phase or when an initial yarn supply is to be wound onto the storage surface.

Figure 3:
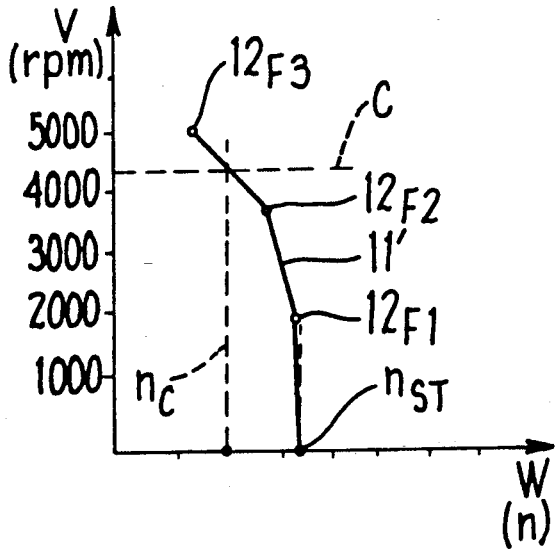
FIG. 3 shows a diagram illustrating alternative developments of desired values.

The diagram shown in FIG. 3 is similar to the one depicted in FIG. 2, there being, however, only three points $12_{F3}$, $12_{F2}$ and $12_{F1}$ for three predetermined desired values, resulting in a broken curve 11'. The desired values along this curve 11' are likewise capable of ensuring that the size of the yarn supply is reduced with increasing winding speed. Also shown in FIG. 3 is the alternative possibility of varying the desired value, proceeding from nST for the starting number, in only a single step, to result in a lower desired value nC. In the present case, the vertical (dot-lined) curve representing the adjusted desired value is determined in accordance with an approximately known and substantially constant mean consumption rate, to thereby ensure that the yarn supply is maintained as small as possible at this consumption rate (horizontal dotted line). Although the adjusted desired value nC is shown as proceeding from the winding speed zero, the control operation is only determined by the desired value nC after the start-up phase, so that an oscillating adjustment control is substantially avoided. This simplified solution is useful for instance in colour change and/or irregular colour change weaving operations. The desired value nC is directly applied to control unit 8, for instance by means of a code switch.

In this case the desired value is individually adjustable prior to being processed by the control unit, preferably in an automatic manner.

Figure 4:
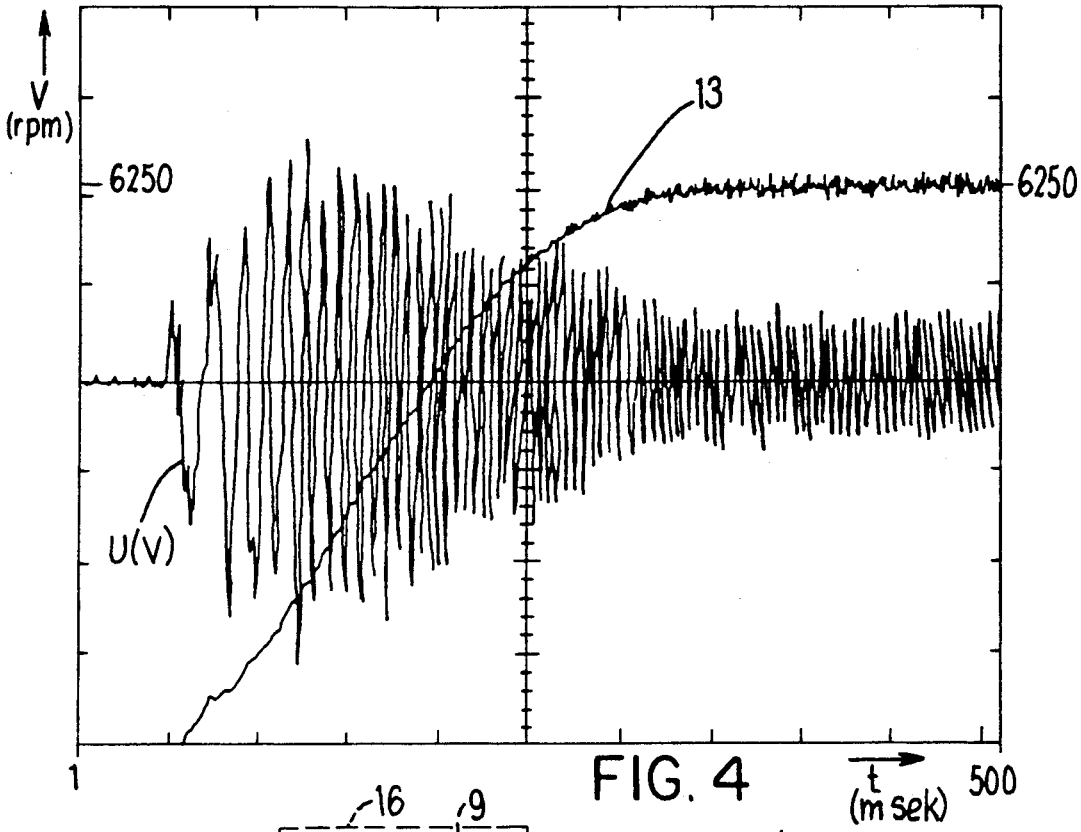
FIG. 4 shows a diagram illustrating the acceleration characteristic or the speed curve, respectively, of a winding drive mechanism of a yarn storage and feeding device.

Curve 11 in FIG. 2 may for instance be derived from the acceleration characteristic 13 of drive mechanism 5 shown in FIG. 4 with reference to a specific drive motor. As shown in FIG. 4, the acceleration curve initially rises relatively steeply and is then gradually flattened to reach a maximum winding speed of 6250 rpm corresponding to about 500 m/sec. The shape of curve 11 shown in FIG. 2 can be determined in accordance with the shape of curve 13 in FIG. 4. Curve 11 may even be a mathematically representable function of curve 13.

In the specific embodiment to which FIG. 2 relates, the desired value nV for the number of windings W on storage surface 6 is only insignificantly reduced at low winding speeds, the reduction of the desired values increasing at higher winding speeds. The points representing the respective desired values on curve 11 or curve 11', respectively, may be calculated or even empirically determined.

Figure 5:
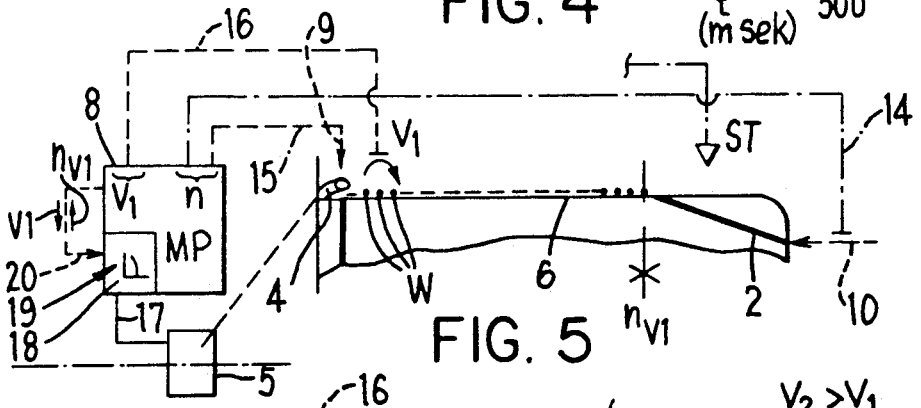
FIG. 5 shows a diagrammatical illustration of the yarn storage and feeding device of FIG. 1 during one operative phase.
Figure 6:
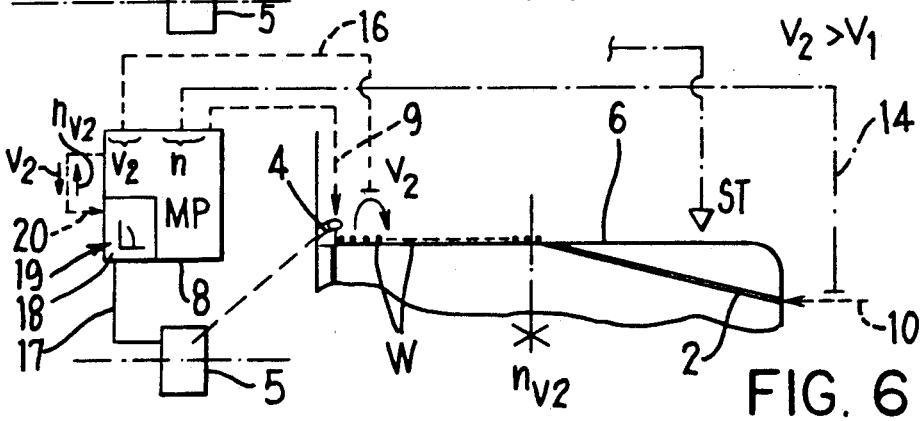
FIG. 6 shows the device of FIG. 1 during another operative phase.

FIGS. 5 and 6 illustrate the method for controlling the yarn storage and feeding device 1 of FIG. 1 in two operative phases during normal operation, in each case in the presence of a state of equilibrium between the means consumption rate and the winding speed, i.e. in a state in which the number of windings wound onto storage surface 6 per time unit corresponds to the number of windings withdrawn therefrom per time unit.

As shown in FIG. 5, drive mechanism 5 and winding element 4 rotate at a winding speed value V1. Consumption monitoring detector 10 is connected to control unit 8 by a control lead 14. Detector device 9 may comprise a detector for monitoring the movement of winding element 4 and applying corresponding signals to control unit 8 via a lead 15. The information relating to the winding speed value V1 is also applied to control unit 8 via a control lead 16. This information might also originate from detector device 9 or from drive mechanism 5, to which control unit 8 is operatively connected via a lead 17. Control unit 8 contains a microprocessor MP capable of determining the actual value of the number of windings from the informations applied thereto.

Control unit 8, or its microprocessor MP, respectively, contains a tabular memory 18 in which the desired values nV are stored at predetermined locations, for instance in the form of a diagram 19 corresponding to the curve shown in FIG. 2. A dash-dotted line 20 in FIG. 5 represents a reading pointer associated to tabular memory 18 and adjustable in accordance with the winding speed to thereby read predetermined locations of tabular memory 18 at correspondingly predetermined winding speed values, so that for instance the desired value nV1 is applied to microprocessor MP in the presence of winding speed value V1. By comparison of the informations applied thereto, microprocessor MP determines whether the actual value corresponds to the desired value nV1, this latter value denoting the axial position of the last winding W of the yarn supply on storage surface 6 in the embodiment shown in FIG. 5. If the result of this comparison is zero or a value lying within an admissible tolerance range, the previous winding speed V1 is maintained. If on the other hand the comparison of informations shows an excessive deviation, control unit 8 operates to accelerate or decelerate drive mechanism 5 to thereby adjust the actual value towards the desired value. This comparison of informations is repeated at predetermined intervals, under the control for instance of a clock circuit associated to microprocessor MP.

In the state shown in FIG. 6, the comparison of informations is carried out at a higher winding speed value V2, in response to which the smaller desired value nV2 is read from tabular memory 18. In this figure it is shown that the yarn supply at the winding speed V2 is smaller than in the state shown in FIG. 5.

If the result of the comparison of informations is zero or a value within an admissible tolerance range, the actual winding speed V2 is maintained. If on the other hand the result shows an inadmissible deviation, control unit 8 operates to adjust the winding speed to a higher or lower value, and to carry out further comparisons of informations to thereby match the actual value with the desired value.

In summary, the control unit controls the winding speed in accordance with the desired values to thereby maintain an optimum smallness of the yarn supply at least at selected winding speed values.

The control operation is carried out in a closed control loop, with the desired values acting as reference values for the control operation. In the embodiment described above with reference to FIGS. 1 to 6, the desired value is varied as a fictitious quantity, without determining the actual value by directly scanning the yarn supply on the storage surface.

Figure 7:
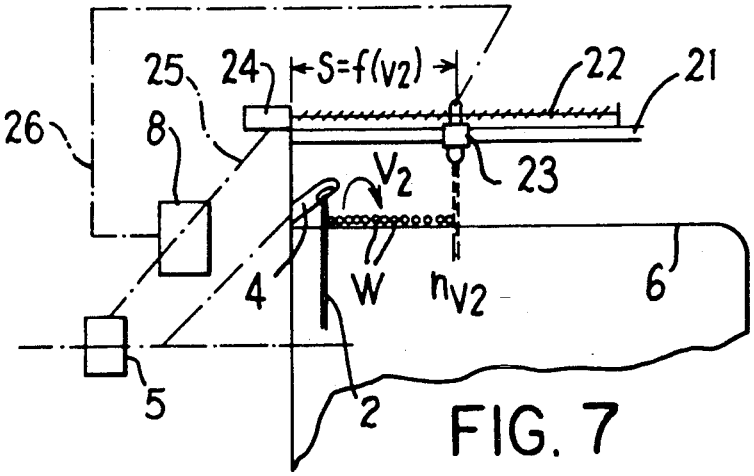
FIG. 7 shows a partial diagrammatical side view of another embodiment of the invention

In the embodiment shown in FIG. 7, a longitudinally extending guide 21 associated to storage surface 6 carries a narrow-range yarn detector 23 for displacement therealong parallel to storage surface 6. Yarn detector 23 is coupled to a drive spindle 22 operatively connected to an adjustment drive mechanism 24. The operation of adjustment drive mechanism 24 is controlled via a control lead 25—either through control unit 8 or directly—in accordance with the winding speed of winding drive mechanism 5 in such a manner that the distance s between yarn detector 23 and the inner end of guide 21 is a function of the actual winding speed V2. When the winding speed is increased, yarn detector 23 is displaced towards the inner end of guide 21; if on the other hand the winding speed is reduced, yarn detector 23 is displaced in the opposite direction. Yarn detector 23 is operatively connected to control unit 8 of drive mechanism 5 via a control lead 26. In a conventional and therefore not shown manner control unit 8 operates to control the winding speed of winding element 4 in such a manner that the size of the yarn supply always corresponds to a desired value associated to a respective winding speed, the size of the yarn supply being determined by the actual distance between yarn detector 23 and the inner end of guide 21.

In the embodiment according to FIG. 7, the control operation may be carried out on the basis of the varying desired value and with reference to the analogous actual value, similar to the manner illustrated in FIGS. 5 and 6.

In FIG. 7 it is important that the adjustment drive mechanism 24 is operable to displace yarn detector 23 not in a linear relationship, but rather at an increasing rate towards the inner end of guide 21 in accordance with the increase of the winding speed.

Figure 8:
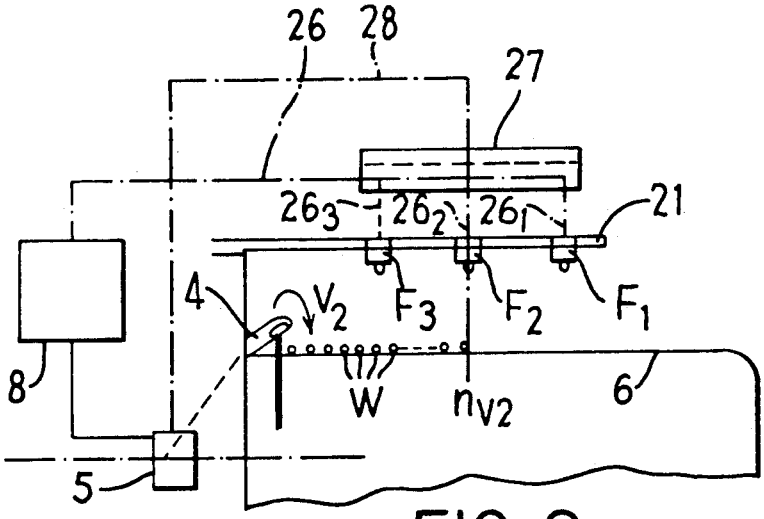
FIG. 8 shows a partial diagrammatical side view of a further embodiment of the invention.

In the embodiment according to FIG. 8, the operation of which corresponds to the diagram (solid-line curve 11') of FIG. 3, guide 21 carries three yarn detectors F1, F2 and F3 secured thereto at longitudinal spacings parallel to storage surface 6. A commutator switch 27 is provided for selectively connecting control lead 26 associated to control unit 8 to any one of three control lead branches $26_1$, $26_2$ and $26_3$. A control lead 28 is provided for selectively operating commutator switch 27 in accordance with the winding speed of drive mechanism 5, so that at any time only one of yarn detectors F1, F2 and F3 is operatively connected to control unit 8. As the winding speed increases, commutator switch 27 switches from yarn detector F1 to yarn detector F2, and subsequently to yarn detector F3, in each case in the presence of a predetermined value of the winding speed. At the winding speed V2 as shown in FIG. 8, yarn detector F2 is activated. The signals generated by yarn detector F2 are used by control unit 8 for maintaining the last winding of the yarn supply at the location of yarn detector F2, in accordance with the desired value nV2 associated to the winding speed V2. For adapting the device to different operating conditions, the yarn detectors can be individually adjusted along guide 21. It is also possible to provide more than three yarn detectors for permitting a finer graduation of the desired values.

Figure 9:
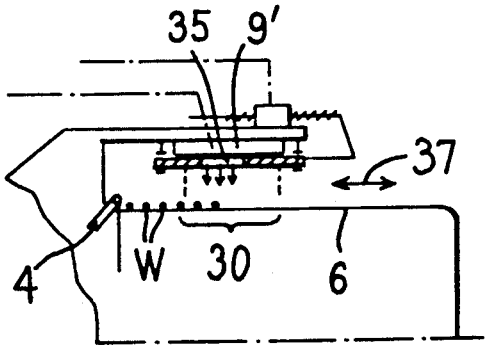
FIG. 9 shows a further embodiment of the invention.

Referring to FIG. 9, it would also be conceivable to provide a fixedly installed wide-band detector 9', preferably a so-called CCD-opto-sensor or a photocell matrix for monitoring the yarn supply as a whole or at least a major part thereof adjacent the exit end of the device, and to electronically control the wide-band detector in such a manner that an active detecting section thereof is displaced within the detecting range 30 in the sense of a reduction of the yarn supply in response to an increase of the winding speed. A similar effect could be produced by the displacement of a shutter-opening 35 in front of the wide-band detector 9' as indicated by arrow 37.

In all of the embodiments described, the size of the yarn supply required at a state of equilibrium between the mean consumption rate and the winding speed is reduced in response to an increase of the winding speed, to thereby exploit the effect that the winding drive mechanism can replenish the yarn supply more rapidly at higher winding speeds than at lower winding speeds. By the establishment of a desired value for the size of the yarn supply and the reduction or variation of the desired value in accordance with the variation of the winding speed, this is accomplished either by electronic operations in the control unit or in a semi-mechanical process with the aid of correspondingly adjustable or selectively operable detector means.

We claim:

1. A method for controlling a yarn storage and feeding device, said device comprising a storage surface on which the yarn can be wound in windings and from which the yarn can be withdrawn intermittently by a consumer, a winding drive for winding the yarn onto the storage surface, and a control unit for controlling the winding drive, said control unit being operable to adjust the winding speed of the winding drive as a function of the yarn consumption represented by the actual number of windings on the storage surface to adjust said actual number of windings to a predetermined desired value, the method comprising the steps of:

detecting the actual number of windings on the storage surface and the winding speed of the winding drive;

achieving a state of approximate equilibrium between the number of windings being wound on said storage surface and the number of windings being consumed, including the steps of increasing the winding speed if the actual detected number of windings is smaller than said desired value and decreasing the winding speed if the actual number of windings exceeds said desired value;

presetting said desired value and presenting it in signal form to the control unit; and altering said desired value to another desired value in response to a detection of a change in the winding speed so that said state of approximate equilibrium will be achieved at a different number of windings than with said first-mentioned desired value.

2. A method according to claim 1, wherein said step of altering the desired value includes at least one of the steps of lowering the desired value in response to an increase in winding speed so that said state of approximate equilibrium is achieved at a lower number of windings than with said first-mentioned desired value, and raising the desired value in response to a decrease in winding speed so that said state of equilibrium is achieved at a higher number of windings than with said first-mentioned desired value.

3. A method according to claim 2, wherein said step of altering the desired value is performed in an automatic manner.

4. A method according to claim 2, wherein said step of altering the desired value includes altering the desired value when the winding speed exceeds a predetermined winding speed value.

5. A method according to claim 2, wherein said presetting step includes setting said first-mentioned desired value to a starting number of windings which depends on at least one of the yarn storing capability of the storage surface and the yarn consumption capability of the consumer, and wherein said altering step includes stepwise altering the desired value inversely to the winding speed as soon as said detected actual number of windings exceeds said starting number.

6. A method according to claim 5, wherein said altering step includes altering the desired value in accordance with a known average consumption of the consumer.

7. A method according to claim 2, wherein said presetting step includes setting said first-mentioned desired value to a starting number which is determined in accordance with at least one of an acceleration response capability of said winding drive and the maximum consumption capability of the consumer.

8. A method according to claim 2, wherein said altering step includes altering the desired value as a mathematical function of the winding speed.

9. A method according to claim 2, wherein the winding drive has a known acceleration characteristic, said altering step including altering the desired value as a function of the acceleration characteristic of said winding drive.

10. A method according to claim 2, comprising the steps of associating different desired values to selected winding speed values, supplying said control unit with the respective desired value in response to the operation of the winding drive at one of said selected winding speed values, and supplying said control unit with the detected actual number of windings, said step of achieving approximate equilibrium including comparing the desired value to said actual number of windings, changing the winding speed in response to the result of said comparing step, and repeating said comparing step in response to the operation of the winding drive at another one of said selected winding speed values.

11. A method according to claim 2, wherein said step of achieving approximate equilibrium includes comparing the desired value to the actual detected number of windings, and wherein said altering step and said detecting step and said step of achieving approximate equilibrium are executed repeatedly to define a repetitively executed closed control loop wherein a current desired value is compared to a current actual detected number of windings during each execution of the control loop, said detecting step including counting the windings being wound on said storage surface and the windings being withdrawn by consumption from said storage surface.

12. A yarn storage and feeding device, comprising a yarn storage surface for storing yarn windings thereon prior to ultimate withdrawal of the yarn windings therefrom by a consumer, a winding drive mechanism for winding yarn onto said storage surface, and a control means for controlling the winding speed of the winding drive mechanism in response to the consumption of yarn by the consumer and according to at least one desired value of the number of yarn windings desired to be stored on said storage surface in order to achieve a state of approximate equilibrium between the windings being wound on said storage surface and the windings being withdrawn therefrom, said control means including means for determining said desired value in response to the winding speed so that the desired value is smaller the higher the winding speed is.

13. A yarn storage and feeding device according to claim 12, wherein said desired value determining means includes a reference value memory means for storing therein a plurality of different winding speeds and a plurality of different desired values which correspond to the respective winding speeds and decrease in magnitude with increasing winding speed so that the desired value corresponding to a given winding speed is smaller the higher the winding speed is.

14. A yarn storage and feeding device according to claim 13, wherein the magnitudes of said desired values stored by said reference value memory means define a curve which extends over an operational winding speed range of said winding drive mechanism and which is a methematical function of an acceleration curve of said winding drive mechanism.

15. A yarn storage and feeding device according to claim 13, comprising a microprocessor in said control means and comprising detector means for supplying said control means with information indicative of the number of windings wound on and of the number of windings consumed from said storage surface and of at least one said desired value of the number of windings, said reference value memory means comprising a readable memory in said microprocessor for storing a plurality of winding speed-dependent desired values, said desired value determining means including means for reading a desired value from said memory at any selected winding speed value, said microprocessor including means for determining an actual value of the number of windings on said storage surface on the basis of said information, and means for comparing said actual value to the desired value as read from said memory, and said control means including means for adjusting the winding speed based on said comparison between said actual value and said desired value.

16. A yarn storage and feeding device according to claim 15, wherein said memory is a tabular memory having a plurality of storage locations for storing the desired values, said desired value determining means including an adjustable pointer means for addressing the respective storage locations in response to variations in the winding speed.

17. A yarn storage and feeding device according to claim 13, wherein said desired values are respectively associated to winding speed values selected at uniform intervals.

18. A yarn storage and feeding device according to claim 17, wherein the intervals between successive desired values within the plurality of desired values increase with increasing winding speed.

19. A yarn storage and feeding device according to claim 13, wherein said reference value memory means comprises a code switch means for permitting said desired value to be adjusted to an average consumption associated with the consumer.

20. A yarn storage and feeding device according to claim 12, wherein said desired value determining means comprises more than two yarn detectors which are distributed alongside said storage surface and are directed onto said storage surface, said yarn detectors being located alongside said storage surface at respective positions which positionally correspond to respective predetermined desired values of the number of windings to be stored on said storage surface, and commutator means for selecting respective ones of said yarn detectors in accordance with the winding speed in order to switch from one desired value to another in response to a variation of the winding speed.

21. A yarn storage and feeding device according to claim 12, wherein said desired value determining means comprises a yarn detector means for generating a signal when the actual number of windings on the storage surface is approximately equal to the desired value, said yarn detector means including a yarn detector mounted for adjustment alongside said storage surface in a longitudinal direction thereof to adjustably define the desired value, and an adjustment drive mechanism connected to said yarn detector and operable to adjust said yarn detector longitudinally along said storage surface in dependence on variations in the winding speed so as to alter the desired value by shifting the yarn detector in the longitudinal direction alongside said storage surface upon actuation of said adjustment drive mechanism.

22. A yarn storing and feeding device according to claim 12, wherein said desired value determining means comprises a wide-band yarn winding detector having an active winding detecting section extending in a longitudinal direction alongside said storage surface, said wide-band yarn winding detector being one of a CCD-detector and a photocell matrix, the active winding detecting section being limitable in length in the longitudinal direction, and means for shifting the active winding detecting section within the wide-band detecting range in accordance with variations of the winding speed in order to alter the desired value of the number of windings on the storage surface.

* * * * *